US010337840B2

(12) United States Patent
Phillips et al.

(10) Patent No.: US 10,337,840 B2
(45) **Date of Patent: *Jul. 2, 2019**

(54) WIRELESSLY CONDUCTED ELECTRONIC WEAPON

(71) Applicant: Digital Ally, Inc., Lenexa, KS (US)

(72) Inventors: Steven L. Phillips, Olathe, KS (US); Peng Han, Overland Park, KS (US); Stanton E. Ross, Overland Park, KS (US); James W. Farnham, IV, Olathe, KS (US)

(73) Assignee: Digital Ally, Inc., Lenexa, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/834,877

(22) Filed: Dec. 7, 2017

(65) Prior Publication Data

US 2018/0106577 A1 Apr. 19, 2018

Related U.S. Application Data

(63) Continuation of application No. 15/163,969, filed on May 25, 2016, now Pat. No. 9,841,259.

(Continued)

(51) Int. Cl.

*F41H 13/00* (2006.01)
*F41F 7/00* (2006.01)

(Continued)

(52) U.S. Cl.

CPC ..... *F41H 13/0031* (2013.01); *F41A 17/063* (2013.01); *F41B 11/80* (2013.01); *F41F 7/00* (2013.01)

(58) Field of Classification Search

CPC ..... F41H 13/0031; F41A 17/063; F41F 7/00; F41B 11/80

See application file for complete search history.

(56) References Cited

U.S. PATENT DOCUMENTS 4,409,670 A 10/1983 Herndon et al.
4,789,904 A 12/1988 Peterson (Continued)

FOREIGN PATENT DOCUMENTS

DE 102010019451 A1 11/2011
EP 2479993 A2 7/2012

(Continued)

OTHER PUBLICATIONS

Automation Systems Article, Know-How Bank Co. Ltd. Takes Leap Forward as a Company Specializing in R&D and Technology Consulting, published Jan. 2005.

(Continued)

*Primary Examiner* — Joshua T Semick
(74) *Attorney, Agent, or Firm* — Erise IP, P.A.

(57) ABSTRACT

An electroshock system wirelessly delivers a shock to a subject. The electroshock system may include a launcher, a wireless projectile, a power source, and a wireless power transmitter. The launcher is configured to be grasped by a user. The wireless projectile is configured to detach from the launcher and adhere to a subject. The power source contributes power for the administration of a shock to the subject. The wireless power transmitter delivers said contributed power to the wireless projectile while the wireless projectile is detached from the launcher. The power source and the wireless transmitter may be co-located with the launcher, or may be separate (such as secured to a person or within a vehicle).

20 Claims, 4 Drawing Sheets

Related U.S. Application Data

(60) Provisional application No. 62/255,602, filed on Nov. 16, 2015, provisional application No. 62/166,495, filed on May 26, 2015.

(51) Int. Cl.
*F41A 17/06* (2006.01)
*F41B 11/80* (2013.01)

(56) References Cited

U.S. PATENT DOCUMENTS 4,863,130 A 9/1989 Marks, Jr.
4,918,473 A 4/1990 Blackshear
5,027,104 A 6/1991 Reid
5,096,287 A 3/1992 Kaikinami et al.
5,111,289 A 5/1992 Lucas et al.
5,289,321 A 2/1994 Secor
5,381,155 A 1/1995 Gerber
5,408,330 A 4/1995 Squicciarii et al.
5,446,659 A 8/1995 Yamawaki
5,453,939 A 9/1995 Hoffman et al.
5,473,501 A * 12/1995 Claypool ..... F41H 13/0031 102/201
5,473,729 A 12/1995 Bryant et al.
5,479,149 A 12/1995 Pike
5,497,419 A 3/1996 Hill
5,526,133 A 6/1996 Paff
5,585,798 A 12/1996 Yoshioka et al.
5,642,285 A 6/1997 Woo et al.
5,668,675 A 9/1997 Fredricks
5,689,442 A 11/1997 Swanson et al.
5,742,336 A 4/1998 Lee
5,752,632 A 5/1998 Sanderson et al.
5,798,458 A 8/1998 Monroe
5,815,093 A 9/1998 Kikinis
5,850,613 A 12/1998 Bullecks
5,878,283 A 3/1999 House et al.
5,886,739 A 3/1999 Winningstad
5,890,079 A 3/1999 Levine
5,926,210 A 7/1999 Hackett et al.
5,962,806 A * 10/1999 Coakley ..... F42B 12/36 102/293
5,978,017 A 11/1999 Tino
5,983,161 A 11/1999 Lemelson et al.
5,996,023 A 11/1999 Winter et al.
6,008,841 A 12/1999 Charlson
6,028,528 A 2/2000 Lorenzetti et al.
6,052,068 A 4/2000 Price R-W et al.
6,097,429 A 8/2000 Seeley et al.
6,100,806 A 8/2000 Gaukel
6,121,881 A 9/2000 Bieback et al.
6,141,609 A 10/2000 Herdeg et al.
6,141,611 A 10/2000 Mackey et al.
6,163,338 A 12/2000 Johnson et al.
6,175,300 B1 1/2001 Kendrick
6,298,290 B1 10/2001 Abe et al.
6,310,541 B1 10/2001 Atkins
6,314,364 B1 11/2001 Nakamura
6,324,053 B1 11/2001 Kamijo
6,326,900 B2 12/2001 Deline et al.
6,333,694 B2 12/2001 Pierce et al.
6,333,759 B1 12/2001 Mazzilli
6,370,475 B1 4/2002 Breed et al.
RE37,709 E 5/2002 Dukek
6,389,340 B1 5/2002 Rayner
6,396,403 B1 5/2002 Haner
6,405,112 B1 6/2002 Rayner
6,449,540 B1 9/2002 Rayner
6,452,572 B1 9/2002 Fan et al.
6,490,409 B1 12/2002 Walker
6,518,881 B2 2/2003 Monroe
6,525,672 B2 2/2003 Chainer et al.
6,546,119 B2 4/2003 Ciolli et al.
6,560,463 B1 5/2003 Santhoff
6,563,532 B1 5/2003 Strub et al.
6,591,242 B1 7/2003 Karp et al.
6,681,195 B1 1/2004 Poland et al.
6,690,268 B2 2/2004 Schofield et al.
6,697,103 B1 2/2004 Fernandez et al.
6,718,239 B2 4/2004 Rayer
6,727,816 B1 4/2004 Helgeson
6,748,792 B1 6/2004 Freund et al.
6,823,621 B2 11/2004 Gotfried
6,831,556 B1 12/2004 Boykin
6,856,873 B2 2/2005 Breed et al.
6,877,434 B1 * 4/2005 McNulty, Jr. ..... F41H 13/0025 102/502
6,883,694 B2 4/2005 Abelow
6,970,183 B1 11/2005 Monroe
7,012,632 B2 3/2006 Freeman et al.
7,034,683 B2 4/2006 Ghazarian
D520,738 S 5/2006 Tarantino
7,038,590 B2 5/2006 Hoffman et al.
7,071,969 B1 7/2006 Stimson, III
7,088,387 B1 8/2006 Freeman et al.
7,119,832 B2 10/2006 Blanco et al.
7,126,472 B2 10/2006 Kraus et al.
7,147,155 B2 12/2006 Weekes
7,180,407 B1 2/2007 Guo et al.
7,190,822 B2 3/2007 Gammenthaler
7,363,742 B2 4/2008 Nerheim
7,371,021 B2 5/2008 Ross et al.
7,421,024 B2 9/2008 Castillo
7,436,143 B2 * 10/2008 Lakshmanan ..... F41H 7/005 318/568.12
7,436,955 B2 10/2008 Yan et al.
7,448,996 B2 11/2008 Khanuja et al.
7,456,875 B2 11/2008 Kashiwa
7,496,140 B2 2/2009 Winningstad et al.
7,500,794 B1 3/2009 Clark
7,508,941 B1 3/2009 O'Toole, Jr. et al.
7,536,457 B2 5/2009 Miller
7,539,533 B2 5/2009 Tran
7,561,037 B1 7/2009 Monroe
7,594,305 B2 9/2009 Moore
7,602,301 B1 10/2009 Stirling et al.
7,602,597 B2 * 10/2009 Smith ..... F41H 13/0018 361/232
7,631,452 B1 * 12/2009 Brundula ..... F41A 17/063 361/232
7,656,439 B1 2/2010 Manico et al.
7,659,827 B2 2/2010 Gunderson et al.
7,680,947 B2 3/2010 Nicholl et al.
7,697,035 B1 4/2010 Suber, III et al.
7,701,692 B2 * 4/2010 Smith ..... F41H 13/0018 361/232
7,778,004 B2 * 8/2010 Nerheim ..... F41A 17/063 361/232
7,804,426 B2 9/2010 Etcheson
7,806,525 B2 10/2010 Howell et al.
7,853,944 B2 12/2010 Choe
7,944,676 B2 5/2011 Smith et al.
7,984,579 B2 * 7/2011 Brundula ..... F41H 13/0012 361/232
8,077,029 B1 12/2011 Daniel et al.
8,121,306 B2 2/2012 Cilia et al.
8,175,314 B1 5/2012 Webster
8,269,617 B2 9/2012 Cook et al.
8,314,708 B2 11/2012 Gunderson et al.
8,356,438 B2 * 1/2013 Brundula ..... F41A 17/063 42/1.08
8,373,567 B2 2/2013 Denson
8,373,797 B2 2/2013 Ishii et al.
8,384,539 B2 2/2013 Denny et al.
8,446,469 B2 5/2013 Blanco et al.
8,456,293 B1 6/2013 Trundle et al.
8,508,353 B2 8/2013 Cook et al.
8,559,486 B2 * 10/2013 Kitayoshi ..... G06K 19/07749 375/219
8,594,485 B2 11/2013 Brundula
8,606,492 B1 12/2013 Botnen
8,676,428 B2 3/2014 Richardson et al.

(56) References Cited

U.S. PATENT DOCUMENTS 8,707,758 B2 4/2014 Keays
8,725,462 B2 5/2014 Jain et al.
8,744,642 B2 6/2014 Nemat-Nasser et al.
8,780,205 B2 7/2014 Boutell et al.
8,781,292 B1 7/2014 Ross et al.
8,805,431 B2 8/2014 Vasavada et al.
8,849,501 B2 9/2014 Cook et al.
8,854,199 B2 10/2014 Cook et al.
8,930,072 B1 1/2015 Lambert et al.
8,989,914 B1 3/2015 Nemat-Nasser et al.
8,996,234 B1 3/2015 Tamari et al.
9,003,474 B1 4/2015 Smith
9,058,499 B1 6/2015 Smith
9,122,082 B2 9/2015 Abreau
9,164,543 B2 10/2015 Minn et al.
9,253,452 B2 2/2016 Ross et al.
9,518,727 B1 * 12/2016 Markle ..... F21V 33/0076
9,841,259 B2 * 12/2017 Phillips ..... F41H 13/0031
2001/0033661 A1 10/2001 Prokoski
2002/0013517 A1 1/2002 West et al.
2002/0019696 A1 2/2002 Kruse
2002/0032510 A1 3/2002 Tumball et al.
2002/0044065 A1 4/2002 Quist et al.
2002/0049881 A1 4/2002 Sugimura
2002/0084130 A1 7/2002 Der Gazarian et al.
2002/0131768 A1 9/2002 Gammenthaler
2002/0135336 A1 9/2002 Zhou et al.
2002/0159434 A1 10/2002 Gosior et al.
2002/0191952 A1 12/2002 Fiore et al.
2003/0040917 A1 2/2003 Fiedler
2003/0080713 A1 5/2003 Kirmuss
2003/0080878 A1 5/2003 Kirmuss
2003/0081121 A1 5/2003 Kirmuss
2003/0081934 A1 5/2003 Kirmuss
2003/0081935 A1 5/2003 Kirmuss
2003/0081942 A1 5/2003 Melnyk et al.
2003/0095688 A1 5/2003 Kirmuss
2003/0106917 A1 6/2003 Shelter et al.
2003/0133018 A1 7/2003 Ziemkowski
2003/0151510 A1 8/2003 Quintana et al.
2003/0184674 A1 10/2003 Manico et al.
2003/0185417 A1 10/2003 Alattar et al.
2003/0215010 A1 11/2003 Kashiwa
2003/0215114 A1 11/2003 Kyle
2003/0222982 A1 12/2003 Hamdan et al.
2004/0008255 A1 1/2004 Lewellen
2004/0043765 A1 3/2004 Tolhurst
2004/0143373 A1 6/2004 Ennis
2004/0145457 A1 7/2004 Schofield et al.
2004/0150717 A1 8/2004 Page et al.
2004/0168002 A1 8/2004 Accarie et al.
2004/0199785 A1 10/2004 Pederson
2004/0223054 A1 11/2004 Rotholtz
2004/0243734 A1 12/2004 Kitagawa et al.
2004/0267419 A1 12/2004 Jing
2005/0030151 A1 2/2005 Singh
2005/0046583 A1 3/2005 Richards
2005/0050266 A1 3/2005 Haas et al.
2005/0068169 A1 3/2005 Copley et al.
2005/0068417 A1 3/2005 Kreiner et al.
2005/0083404 A1 4/2005 Pierce et al.
2005/0094966 A1 5/2005 Elberbaum
2005/0100329 A1 5/2005 Lao et al.
2005/0101334 A1 5/2005 Brown et al.
2005/0134966 A1 5/2005 Burgner
2005/0132200 A1 6/2005 Jaffe et al.
2005/0151852 A1 7/2005 Jomppanen
2005/0035161 A1 8/2005 Shioda
2005/0185438 A1 8/2005 Ching
2005/0206532 A1 9/2005 Lock
2005/0206741 A1 9/2005 Raber
2005/0228234 A1 10/2005 Yang
2005/0232469 A1 10/2005 Schofield et al.
2005/0243171 A1 11/2005 Ross, Sr. et al.
2005/0258942 A1 11/2005 Manasseh et al.
2006/0009238 A1 1/2006 Stanco et al.
2006/0028811 A1 2/2006 Ross, Jr. et al.
2006/0055786 A1 3/2006 Olilla
2006/0158968 A1 7/2006 Vanman et al.
2006/0164220 A1 7/2006 Harter, Jr. et al.
2006/0164534 A1 7/2006 Robinson et al.
2006/0170770 A1 8/2006 MacCarthy
2006/0176149 A1 8/2006 Douglas
2006/0183505 A1 8/2006 Willrich
2006/0193749 A1 8/2006 Ghazarian et al.
2006/0203090 A1 9/2006 Wang et al.
2006/0220826 A1 10/2006 Rast
2006/0225253 A1 10/2006 Bates
2006/0244601 A1 11/2006 Nishimura
2006/0256822 A1 11/2006 Kwong et al.
2006/0270465 A1 11/2006 Lee et al.
2006/0271287 A1 11/2006 Gold et al.
2006/0274166 A1 12/2006 Lee et al.
2006/0274828 A1 12/2006 Siemens et al.
2006/0276200 A1 12/2006 Radhakrishnan et al.
2006/0282021 A1 12/2006 DeVaul et al.
2006/0287821 A1 12/2006 Lin
2006/0293571 A1 12/2006 Bao et al.
2007/0021134 A1 1/2007 Liou
2007/0064108 A1 3/2007 Haler
2007/0067079 A1 3/2007 Kosugi
2007/0091557 A1 4/2007 Kim et al.
2007/0102508 A1 5/2007 Mcintosh
2007/0117083 A1 5/2007 Winneg et al.
2007/0132567 A1 6/2007 Schofield et al.
2007/0152811 A1 7/2007 Anderson
2007/0172053 A1 7/2007 Poirier
2007/0177023 A1 8/2007 Beuhler et al.
2007/0199076 A1 8/2007 Rensin et al.
2007/0229350 A1 10/2007 Scalisi et al.
2007/0257781 A1 11/2007 Denson
2007/0257782 A1 11/2007 Etcheson
2007/0257804 A1 11/2007 Gunderson et al.
2007/0257815 A1 11/2007 Gunderson et al.
2007/0260361 A1 11/2007 Etcheson
2007/0268158 A1 11/2007 Gunderson et al.
2007/0271105 A1 11/2007 Gunderson et al.
2007/0274705 A1 11/2007 Kashiwa
2007/0277352 A1 12/2007 Maron et al.
2007/0285222 A1 12/2007 Zadnikar
2007/0287425 A1 12/2007 Bates
2007/0297320 A1 12/2007 Brummette et al.
2008/0001735 A1 1/2008 Tran
2008/0002031 A1 1/2008 Cana et al.
2008/0002599 A1 2/2008 Denny et al.
2008/0030580 A1 2/2008 Kashhiawa et al.
2008/0042825 A1 2/2008 Denny et al.
2008/0043736 A1 2/2008 Stanley
2008/0049830 A1 2/2008 Richardson
2008/0063252 A1 3/2008 Dobbs et al.
2008/0084473 A1 4/2008 Romanowich
2008/0100705 A1 5/2008 Kister et al.
2008/0122603 A1 5/2008 Piante et al.
2008/0129518 A1 6/2008 Carlton-Foss
2008/0143481 A1 6/2008 Abraham et al.
2008/0144705 A1 6/2008 Rackin et al.
2008/0169929 A1 7/2008 Albertson et al.
2008/0170130 A1 7/2008 Ollila et al.
2008/0211906 A1 9/2008 Lovric
2008/0222849 A1 9/2008 Lavoie
2008/0239064 A1 10/2008 Iwasaki
2008/0246656 A1 10/2008 Ghazarian
2008/0266118 A1 10/2008 Pierson et al.
2008/0307435 A1 12/2008 Rehman
2008/0316314 A1 12/2008 Bedell et al.
2009/0002491 A1 1/2009 Haler
2009/0002556 A1 1/2009 Manapragada et al.
2009/0027499 A1 1/2009 Nicholl
2009/0052685 A1 2/2009 Cilia et al.
2009/0070820 A1 3/2009 Li
2009/0122142 A1 5/2009 Shapley
2009/0135007 A1 5/2009 Donovan et al.
2009/0169068 A1 7/2009 Okamoto
2009/0189981 A1 7/2009 Siann

(56) References Cited

U.S. PATENT DOCUMENTS

| | | | |
|---|---|---|---|
| 2009/0195686 | A1 | 8/2009 | Shintani |
| 2009/0207252 | A1 | 8/2009 | Raghunath |
| 2009/0213204 | A1 | 8/2009 | Wong |
| 2009/0225189 | A1 | 9/2009 | Morin |
| 2009/0243794 | A1 | 10/2009 | Morrow |
| 2009/0251545 | A1 | 10/2009 | Shekarri et al. |
| 2009/0252486 | A1 | 10/2009 | Ross, Jr. et al. |
| 2009/0276708 | A1 | 11/2009 | Smith et al. |
| 2009/0294538 | A1 | 12/2009 | Wihlborg et al. |
| 2009/0324203 | A1 | 12/2009 | Wiklof |
| 2010/0045798 | A1 | 2/2010 | Sugimoto et al. |
| 2010/0050734 | A1 | 3/2010 | Chou |
| 2010/0060747 | A1 | 3/2010 | Woodman |
| 2010/0097221 | A1 | 4/2010 | Kriener et al. |
| 2010/0106707 | A1 | 4/2010 | Brown et al. |
| 2010/0118147 | A1 | 5/2010 | Dorneich et al. |
| 2010/0122435 | A1 | 5/2010 | Markham |
| 2010/0123779 | A1 | 5/2010 | Snyder et al. |
| 2010/0177193 | A1 | 7/2010 | Flores |
| 2010/0177891 | A1 | 7/2010 | Keidar et al. |
| 2010/0188201 | A1 | 7/2010 | Cook et al. |
| 2010/0191411 | A1 | 7/2010 | Cook et al. |
| 2010/0194885 | A1 | 8/2010 | Plaster |
| 2010/0217836 | A1 | 8/2010 | Rofougaran |
| 2010/0238009 | A1 | 9/2010 | Cook et al. |
| 2010/0238262 | A1 | 9/2010 | Kurtz et al. |
| 2010/0242076 | A1 | 9/2010 | Potesta et al. |
| 2010/0265331 | A1 | 10/2010 | Tanaka |
| 2010/0274816 | A1 | 10/2010 | Guzik |
| 2010/0287473 | A1 | 11/2010 | Recesso et al. |
| 2011/0006151 | A1 | 1/2011 | Beard |
| 2011/0018998 | A1 | 1/2011 | Guzik |
| 2011/0050904 | A1 | 3/2011 | Anderson |
| 2011/0069151 | A1 | 3/2011 | Orimoto |
| 2011/0084820 | A1 | 4/2011 | Walter et al. |
| 2011/0094003 | A1 | 4/2011 | Spiewak et al. |
| 2011/0098924 | A1 | 4/2011 | Baladeta et al. |
| 2011/0129151 | A1 | 6/2011 | Saito et al. |
| 2011/0157759 | A1 | 6/2011 | Smith et al. |
| 2011/0187895 | A1 | 8/2011 | Cheng et al. |
| 2011/0261176 | A1 | 10/2011 | Monaghan, Sr. et al. |
| 2011/0281547 | A1 | 11/2011 | Cordero |
| 2011/0301971 | A1 | 12/2011 | Roesch et al. |
| 2011/0314401 | A1 | 12/2011 | Salisbury et al. |
| 2012/0038689 | A1 | 2/2012 | Ishil |
| 2012/0056722 | A1 | 3/2012 | Kawaguchi |
| 2012/0063736 | A1 | 3/2012 | Simmons et al. |
| 2012/0120258 | A1 | 5/2012 | Boutell et al. |
| 2012/0162436 | A1 | 6/2012 | Cordell et al. |
| 2012/0188345 | A1 | 7/2012 | Salow |
| 2012/0189286 | A1 | 7/2012 | Takayama et al. |
| 2012/0195574 | A1 | 8/2012 | Wallace |
| 2012/0230540 | A1 | 9/2012 | Calman et al. |
| 2012/0257320 | A1 | 10/2012 | Brundula et al. |
| 2012/0268259 | A1 | 10/2012 | Igel et al. |
| 2012/0276954 | A1 | 11/2012 | Kowalsky |
| 2013/0021153 | A1 | 1/2013 | Keays |
| 2013/0033610 | A1 | 2/2013 | Osborn |
| 2013/0035602 | A1 | 2/2013 | Gemer |
| 2013/0080836 | A1 | 3/2013 | Stergiou et al. |
| 2013/0096731 | A1 | 4/2013 | Tamari et al. |
| 2013/0125000 | A1 | 5/2013 | Flischhauser et al. |
| 2013/0148295 | A1 | 6/2013 | Minn et al. |
| 2013/0222640 | A1 | 8/2013 | Baek et al. |
| 2013/0225309 | A1 | 8/2013 | Bentley et al. |
| 2013/0285232 | A1 | 10/2013 | Sheth |
| 2013/0300563 | A1 | 11/2013 | Glaze |
| 2013/0343571 | A1 | 12/2013 | Lee |
| 2014/0037262 | A1 | 2/2014 | Sako |
| 2014/0049636 | A1 | 2/2014 | O'Donnell et al. |
| 2014/0092299 | A1 | 4/2014 | Phillips et al. |
| 2014/0094992 | A1 | 4/2014 | Lambert et al. |
| 2014/0098453 | A1 | 4/2014 | Brundula et al. |
| 2014/0140575 | A1 | 5/2014 | Wolf |
| 2014/0170602 | A1 | 6/2014 | Reed |
| 2014/0192194 | A1 | 7/2014 | Bedell et al. |
| 2014/0195105 | A1 | 7/2014 | Lambert et al. |
| 2014/0195272 | A1 | 7/2014 | Sadiq et al. |
| 2014/0210625 | A1 | 7/2014 | Nemat-Nasser |
| 2014/0218544 | A1 | 8/2014 | Senot et al. |
| 2014/0227671 | A1 | 8/2014 | Olmstead et al. |
| 2014/0311215 | A1 | 10/2014 | Keays et al. |
| 2014/0341532 | A1 | 11/2014 | Marathe et al. |
| 2014/0355951 | A1 | 12/2014 | Tabak |
| 2015/0050003 | A1 | 2/2015 | Ross et al. |
| 2015/0050345 | A1 | 2/2015 | Smyth et al. |
| 2015/0051502 | A1 | 2/2015 | Ross |
| 2015/0053776 | A1 | 3/2015 | Rose et al. |
| 2015/0078727 | A1 | 3/2015 | Ross et al. |
| 2015/0088335 | A1 | 3/2015 | Lambert et al. |
| 2015/0103246 | A1 | 4/2015 | Phillips et al. |
| 2015/0229630 | A1 | 8/2015 | Smith |
| 2015/0317368 | A1 | 11/2015 | Rhoads et al. |
| 2015/0332424 | A1 | 11/2015 | Kane et al. |
| 2015/0358549 | A1 | 12/2015 | Cho et al. |
| 2016/0042767 | A1 | 2/2016 | Araya et al. |
| 2016/0104508 | A1 | 4/2016 | Chee et al. |
| 2016/0127695 | A1 | 5/2016 | Zhang et al. |
| 2016/0165192 | A1 | 6/2016 | Saatchi et al. |
| 2016/0364621 | A1 | 12/2016 | Hill et al. |
| 2017/0070659 | A1 | 3/2017 | Kievsky et al. |
| 2017/0195635 | A1 | 7/2017 | Yokomitsu et al. |
| 2017/0230605 | A1 | 8/2017 | Han et al. |
| 2017/0237950 | A1 | 8/2017 | Araya et al. |
| 2017/0244884 | A1 | 8/2017 | Burtey et al. |
| 2017/0277700 | A1 | 9/2017 | Davis et al. |
| 2017/0287523 | A1 | 10/2017 | Hodulik et al. |
| 2018/0023910 | A1 | 1/2018 | Kramer |
| 2018/0050800 | A1 | 2/2018 | Boykin et al. |

FOREIGN PATENT DOCUMENTS

| | | | |
|---|---|---|---|
| GB | 2273624 | | 6/1994 |
| GB | 2320389 | | 5/1998 |
| GB | 2343252 | | 5/2000 |
| GB | 2351055 | | 12/2000 |
| GB | 2417151 | | 2/2006 |
| GB | 2425427 | | 10/2006 |
| GB | 2455885 | | 7/2009 |
| GB | 2485804 | A | 5/2012 |
| IE | 20090923 | A1 | 9/2010 |
| JP | 294188 | | 9/1993 |
| JP | 153298 | | 6/1996 |
| JP | 198858 | | 7/1997 |
| JP | 10076880 | A | 3/1998 |
| JP | 210395 | | 7/1998 |
| JP | 2000137263 | A | 5/2000 |
| JP | 2005119631 | A | 5/2005 |
| KR | 20-0236817 | | 8/2001 |
| KR | 1050897 | | 7/2011 |
| RU | 2383915 | C2 | 3/2010 |
| RU | 107851 | U1 | 8/2011 |
| RU | 124780 | U1 | 2/2013 |
| WO | 9005076 | | 5/1990 |
| WO | 9738526 | | 10/1997 |
| WO | 9831146 | | 7/1998 |
| WO | 9948308 | | 9/1999 |
| WO | 0039556 | | 7/2000 |
| WO | 0051360 | | 8/2000 |
| WO | 0123214 | A1 | 4/2001 |
| WO | 0249881 | | 6/2002 |
| WO | 02095757 | | 11/2002 |
| WO | 03049446 | | 6/2003 |
| WO | 2004036926 | A2 | 4/2004 |
| WO | 2009013526 | A1 | 1/2009 |
| WO | 20110010 | A1 | 1/2011 |
| WO | 2012037139 | A2 | 3/2012 |
| WO | 2012120083 | A1 | 9/2012 |

(56) References Cited

FOREIGN PATENT DOCUMENTS

| | | | |
|---|---|---|---|
| WO | 2014000161 | A1 | 1/2014 |
| WO | 2014052898 | A1 | 4/2014 |

OTHER PUBLICATIONS

Car Rear View Camera—Multimedia Rear View Mirror—4' LCD color monitor, Retrieved from the Internet: <URL: http://web.archive.org/web/20050209014751/http://laipac.com/multimedia-rear-mirror.htm>, Feb. 9, 2005.
ATC Chameleon. Techdad Review [Online] Jun. 19, 2013 [Retrieved on Dec. 30, 2015]. Retrieved from Internet. <URL:http://www.techdadreview.com/2013/06/19atc-chameleon/>.
"Breathalyzer." Wikipedia. Printed Date: Oct. 16, 2014; Date Page Last Modified: Sep. 14, 2014; <http://en.wikipedia.org/wiki/Breathalyzer>.
Dees, Tim; Taser Axon Flex: The next generation of body camera; <http://www.policeone.com/police-products/body-cameras/articles/527231-0-TASER-Axon-Flex-The-next-generation-of-body-camera/>, Date Posted: Mar. 12, 2012; Date Printed: Oct. 27, 2015.
Brown, TP-LINK TL-WDR3500 Wireless N600 Router Review, Mar. 6, 2013.
Controller Area Network (CAN) Overview, National Instruments White Paper, Aug. 1, 2014.
Daskam, Samuel W., Law Enforcement Armed Robbery Alarm System Utilizing Recorded Voice Addresses Via Police Radio Channels, Source: Univ. of Ky, Off of Res and Eng., Sery (UKY BU107), pp. 18-22, 1975.
*Digital Ally* vs. *Taser International, Inc.*, Case No. 2:16-cv-232 (CJM/TJ); US D. Kan, Defendant Taser International Inc.'s Preliminary Invalidity Contentions, Jul. 5, 2016.
Electronic Times Article, published Feb. 24, 2005.
Supplementary European Search Report dated Sep. 28, 2010 in European Patent Application No. 06803645.8; Applicant: Digital Ally, Inc.
W. Fincham, Data Recorders for Accident Investigation, Monitoring of Driver and Vehicle Performance (Digest No. 1997/122), Publication Date: Apr. 10, 1997, pp. 6/1-6/3.
Frankel, Harry; Riter, Stephen, Bernat, Andrew, Automated Imaging System for Border Control, Source: University of Kentucky, Office of Engineering Services, (Bulletin) UKY BU, pp. 169-173, Aug. 1986.
Freudenrich, Craig, Ph.D.; "How Breathalyzers Work—Why Test?." HowStuff Works. Printed Date: Oct. 16, 2014; Posted Date: Unknown; <http://electronics.howstuffworks.com/gadgets/automotive/breathalyzer1.htm>.
Hankyung Auto News Article, Know-How Bank's Black Box for Cars "Multi-Black Box," Copyright 2005.
Guide to Bluetooth Security: Recommendations of the National Institute of Standards and Technology, National Institute of Standards and Technology, U.S. Dep't of Commerce, NIST Special Publication 800-121, Revision 1 (Jun. 2012).
ICOP Extreme Wireless Mic, Operation Supplement, Copyright 2008.
ICOP Model 20/20-W Specifications; Enhanced Digital In-Car Video and Audio recording Systems, date: Unknown.
ICOP Mobile DVRS; ICOP Model 20/20-W & ICOP 20/20 Vision, date: Unknown.
Bertomen, Lindsey J., PoliceOne.com News; "Product Review: ICOP Model 20/20-W," May 19, 2009.
ICOP Raytheon JPS communications, Raytheon Model 20/20-W, Raytheon 20/20 Vision Digital In-Car Video Systems, date: Unknown.
Overview of the IEEE 802.15.4 standards for Low rate Wireless Personal Area Networks, 2010 7th International Symposium on Wireless Communication Systems (ISWCS), Copyright 2010.
Lewis, S.R., Future System Specifications for Traffic Enforcement Equipment, S.R. 1 Source: IEE Colloquium (Digest), N 252, Publication Date: Nov. 18, 1996, pp. 8/1-8/2.
Kopin Corporation; Home Page; Printed Date: Oct. 16, 2014; Posted Date: Unknown; <http://www.kopin.com>.
Translation of Korean Patent No. 10-1050897, published Jul. 20, 2011.
Lilliput RV 18-50NP 5" Rear View Mirror TFT LCD Screen with Camera, Retrieved from the Internet: <URL: http://www.case-mod.com/lilliput-rv1850np-rear-view-mirror-tft-lcd-screen-with-camera-p-1271.html>, Mar. 4, 2005.
Motor Magazine Article, Recreating the Scene of an Accident, published 2005.
New Rearview-Mirror-Based Camera Display Takes the Guesswork Out of Backing up Retrieved from the Internet: <URL: http://news.thomasnet.com/fullstory/497750>, Press Release, Oct. 30, 2006.
SIIF Award for Multi Black Box, published Dec. 10, 2004.
Near Field Communication; Sony Corporation; pp. 1-7, Date: Unknown.
Oregon Scientific ATC Chameleon Dual Lens HD Action Camera, http://www.oregonscientificstore.com/Oregon-Scientific-ATC-Chameleon-Dual-Lens-HD-Action-Camera.data, Date Posted: Unknown; Date Printed: Oct. 13, 2014, pp. 1-4.
Asian Wolf High Quality Angel Eye Body Video Spy Camera Recorder System, http://www.asianwolf.com/covert/bodycam-hq-angeleye.html, Sep. 26, 2013, Date Posted: Unknown, pp. 1-3.
Brick House Security Body Worn Cameras / Hidden Cameras / Covert Spy Cameras, http://www.brickhousesecurity.com/body-wom-covert-spy-cameras.html?sf=0#sortblock&CMPID=PD_Google2/%22body+camera%22&utm_source=google&utm_medium=cpc&utm_term=%22body+camera% 22&mm_campaign=876a94ea5dd198a8c5dc3d1e67eccb34&keyword=%22body+camera%22&utm_source=google&utm_medium=cpc&utm_campaign=Cameras+–+Body+Worn+Cameras&c1=323-29840300-1-t14536730-10363-126010-3009263&gclid=CPiBq7mliq8CFSWFQAodGlsW8g&ad=7592872943, Sep. 26, 2013, Date Posted: Unknown, pp. 1-2.
Amazon.com wearable camcorders, http://www.amazon.com/s/ref=nb_sb_ss_i_0_4?url=search-alias%3Dphoto&field-keywords=wearable+camcorder&x=0&y=08,sprefix=wear,Sep. 26, 2013, Date Posted: Unknown, pp. 1-4.
Notification of Transmittal of the International Search Report and the Written Opinion of the International Searching Authority, or the Declaration dated Feb. 4, 2016; International Application No. PCT/US2015/056052; International Filing Date: Oct. 16, 2015; Applicant: Digital Ally, Inc.
http://www.k-h-b.com/board/board.php?board=products01&comand=body&no=1, Current State of Technology Held by the Company, Copyright 2005.
City of Pomona Request for Proposals for Mobile Video Recording System for Police Vehicles, dated prior to Apr. 4, 2013.
http://www.k-h-b.com/sub1_02.html, Copyright 2005.
Renstrom, Joell; "Tiny 3D Projectors Allow You to Transmit Holograms From a Cell Phone." Giant Freakin Robot. Printed Date: Oct. 16, 2014; Posted Date: Jun. 13, 2014; <http://www.gianffreakinrobot.com/sci/coming-3d-projectors-transmit-holograms-cell-phone.html>.
Request for Comment 1323 of the Internet Engineering Task Force, TCP Extensions for High Performance, Date: May 1992.
RevealMedia RS3-SX high definition video recorder, http://www.revealmedia.com/buy-t166/cameras/rs3-sx.aspx, Sep. 26, 2013, Date Posted: Unknown, pp. 1-2.
Scorpion Micro DV Video Audio Recorder, http://www.leacorp.com/scorpion-micro-dv-video-audio-recorder/, Sep. 26, 2013, Date Posted: Unknown, pp. 1-3.
"Stalker Press Room—Using In-Car Video, the Internet, and the Cloud to keep police officers safe is the subject of CopTrax live, free webinar." Stalker. Printed Date: Oct. 16, 2014; Posted Date: Jul. 31 ,2014.
State of Utah Invitation to Bid State Cooperative Contract; Vendor: ICOP Digital, Inc., Contract No. MA503, Jul. 1, 2008.
Wasson, Brian; "Digital Eyewear for Law Enforcement." Printed Date: Oct. 16, 2014; Posted Date: Dec. 9, 2013; <http://www.wassom.com/digital-eyewear-for-law-enforcement.html>.
X26 Taser, Date Unknown.
Taser International; Taser X26 Specification Sheet, 2003.

(56) References Cited

OTHER PUBLICATIONS

Digital Ally First Vu Mountable Digital Camera Video Recorder, http://www.opticsplanet.com/digital-ally-first-vu-mountable-digital-camera-video-recorder.html?gclid=CIKohcX05rkCFSIo7AodU0IA0g8&ef_id=UjCGEAAAAWGEjrQF:20130925155534:s, Sep. 25, 2013, Date Posted: Unknown, pp. 1-4.
Drift X170, http://driftinnovation.com/support/firmware-update/x170/, Sep. 26, 2013, Date Posted: Unknown, p. 1.
Dyna Spy Inc. hidden cameras, https://www.dynaspy.com/hidden-cameras/spy-cameras/body-worn-wearable-spy-cameras, Sep. 26, 2013, Date Posted: Unknown, pp. 1-3.
Petition for Post Grant Review No. PGR2018-00052, *Axon Enterprise, Inc.* v. *Digital Ally, Inc.*, filed Mar. 19, 2018.
MPEG-4 Coding of Moving Pictures and Audio ISO/IEC JTC1/SC29/WG11 N4668 dated Mar. 2002.
Ecplaza HY-001HD law enforcement DVR, http://fireeye.en.ecplaza.net/law-enforcement-dvr--238185-1619696.html, Sep. 26, 2013, Date Posted: Unknown, pp. 1-3.
Edesix VideoBadge, http://www.edesix.com/edesix-products, Sep. 26, 2013, Date Posted: Unknown, pp. 1-3.
GoPro Official Website: The World's Most Versatile Camera, http://gopro.com/products/?gclid=CKqHv9jT4rkCFWZk7AodyiAAaQ, Sep. 23, 2013, Date Posted: Unknown, pp. 4-9.
Isaw Advance Hull HD EXtreme, www.isawcam.co.kr, Sep. 26, 2013, Date Posted: Unknown, p. 1.
Kustom Signals VieVu, http://www.kustomsignals.com/index.php/mvideo/vievu, Sep. 26, 2013, Date Posted: Unknown, pp. 1-4.
LEA-AID SCORPION Micro Recorder Patrol kit,http:/www.leacorp.com/products/SCORPION-Micro-Recorder-Patrol-kit.html, Sep. 26, 2013, Date Posted: Unknown, pp. 1-2.
Looxcie Wearable & mountable streaming video cams, http://www.looxcie.com/overview?gclid=CPbDyv6piq8CFWeFOADdlhXC-w, Sep. 26, 2013, Date Posted: Unknown, pp. 1-4.
Midland XTC HD Video Camera, http://midlandradio.com/Company/xtc100-signup, Sep. 26, 2013, Date Posted: Unknown, pp. 1-3.
Panasonic Handheld AVCCAM HD Recorder/Player, http://www.panasonic.com/business/provideo/ag-hmr10.asp, Sep. 26, 2013, Date Posted: Unknown, pp. 1-2.
Notification of Transmittal of the International Search Report and the Written Opinion of the International Search Authority, or the Declaration dated Jan. 30, 2014, International Application No. PCT/US2013/062415; International Filing date Sep. 27, 2013, Applicant: Digital Ally, Inc.
Point of View Cameras Military & Police, http://pointofviewcameras.com/military-police, Sep. 26, 2013, Date Posted: Unknown, pp. 1-2.
POV.HD System Digital Video Camera, http://www.vio-pov.com/index.php, Sep. 26, 2013, Date Posted: Unknown, pp. 1-3.
Invalidity Chart for International Publication No. WO2014/000161 Oct. 31, 2017.
PCT Patent Application PCT/US17/16383 International Search Report and Written Opinion dated May 4, 2017.
SIV Security in Vehicle Driving Partner, http://www.siv.co.kr/, Sep. 26, 2013, Date Posted: Unknown, p. 1.
Spy Chest Mini Spy Camera / Self Contained Mini camcorder / Audio & Video Recorder, http://www.spytechs.com/spy_cameras/mini-spy-camera.htm, Sep. 26, 2013, Date Posted: Unknown, pp. 1-3.
Stalker VUE Law Enforcement Grade Body Worn Video Camera/Recorder, http://www.stalkerradar.com/law_vue.shtml, Sep. 26, 2013, Date Posted: Unknown, pp. 1-2.
SUV Cam, http://www.elmo.co.jp/suv-cam/en/product/index.html, Sep. 26, 2013, Date Posted: Unknown, p. 1.
Taser Axon Body on Officer Video/Police Body Camera, http://www.taser.com/products/on-officer-video/axon-body-on-officer-video, Sep. 23, 2013, Date Posted: Unknown, pp. 1-8.
Taser Axon Flex On-Officer Video/Police Video Camera, http://www.taser.com/products/on-officer-video/taser-axon, Sep. 26, 2013, Date Posted: Unknown, pp. 1-8.
Taser Cam Law Enforcement Audio/Video Recorder (gun mounted), http://www.taser.com/products/on-officer-video/taser-cam, Sep. 26, 2013, Date Posted: Unknown, pp. 1-3.
Tide Leader police body worn camera, http://tideleader.en.gongchang.com/product/14899076, Sep. 26, 2013, Date Posted: Unknown, pp. 1-3.
UCorder Pockito Wearable Mini Pocket Camcorder, http://www.ucorder.com/, Sep. 26, 2013, Date Posted: Unknown, p. 1.
Veho MUVI HD, http://veho-uk.fastnet.co.uk/main/shop.aspx?category=CAMMUVIHD, Sep. 26, 2013, Date Posted: Unknown, pp. 1-5.
Veho MUVI portable wireless speaker with dock, http://veho-uk.fastnet.co.uk/main/shop.aspx?category=camcorder, Sep. 26, 2013, Date Posted: Unknown, p. 1.
Vidmic Officer Worn Video & Radio Accessories, http://www.vidmic.com/, Sep. 26, 2013, Date Posted: Unknown, p. 1.
Vievu Products, http://www.vievu.com/vievu-products/vievu-squared/, Sep. 25, 2013, Date Posted: Unknown, pp. 1-2.
WatchGuard CopVu Wearable Video Camera System, http://watchguardvideo.com/copvu/overview, Sep. 26, 2013, Date Posted: Unknown, pp. 1-2.
Witness Cam headset, http://www.secgru.com/DVR-Witness-Cam-Headset-Video-Recorder-SG-DVR-1-COP.html, Sep. 26, 2013, Date Posted: Unknown, pp. 1-2.
WolfCom 3rd Eye, X1 A/V Recorder for Police and Military, http://wolfcomusa.com/Products/Products.html, Sep. 26, 2013, Date Posted: Unknown, pp. 1-3.
Notification of Transmittal of the International Search Report and the Written Opinion of the International Search Authority, or the Declaration dated Jan. 14, 2016, International Application No. PCT/US2015/056039; International Filing date Oct. 16, 2015, Applicant: Digital Ally, Inc.
U.S. Appl. No. 13/959,142 Final Office Action dated Jul. 20, 2016.
U.S. Appl. No. 13/959,142 Office Action dated Nov. 3, 2015.
*Digital Ally, Inc.* vs. *Taser International, Inc.*, Case No. 2:16-cv-020232 (CJM/TJ); US D. Kan, Complaint for Patent Infringement, Jan. 14, 2016.
*Digital Ally, Inc.* vs. *Enforcement video LLC d/b/a Watchguard Video.*, Case No. 2:16-cv-02349 (CJM/TJ); US D. Kan, Complaint for Patent Infringement, May 27, 2016.
International Association of Chiefs of Police Digital Video System Minimum Specifications; Nov. 21, 2008.
Petition for Inter Partes Review No. 2017-00375, *Taser International, Inc.* v. *Digital Ally, Inc.*, filed Dec. 1, 2016.
Petition for Inter Partes Review No. 2017-00376, *Taser International, Inc.* v. *Digital Ally, Inc.*, filed Dec. 1, 2016.
Petition for Inter Partes Review No. 2017-00515, *Taser International, Inc.* v. *Digital Ally Inc.*, filed Jan. 11, 2017.
Petition for Inter Partes Review No. 2017-00775, *Taser International, Inc.* v. *Digital Ally Inc.*, filed Jan. 25, 2017.
PCT Patent Application PCT/US16/34345 International Search Report and Written Opinion dated Dec. 29, 2016.
State of Utah Invitation to Bid State Cooperative Contract; Vendor: Kustom Signals Inc., Contract No. MA1991, Apr. 25, 2008.
U.S. Appl. No. 15/011,132 Office Action dated Apr. 18, 2016, 19 pages.
Zepcam Wearable Video Technology, http://www.zepcam.com/product.aspx, Sep. 26, 2013, Date Posted: Unknown, pp. 1-2.
Invalidity Chart for International Publication No. WO2014/000161 Oct. 31, 2017 (Resubmitted).
European Patent Application 15850436.6 Search Report dated May 4, 2018.
Final Written Decision for Inter Partes Review No. 2017-00375, *Axon Enterprise Inc.* v. *Digital Ally, Inc.*, issued Jun. 1, 2018.

* cited by examiner

WIRELESSLY CONDUCTED ELECTRONIC WEAPON

RELATED APPLICATIONS

This is a continuation patent application which claims priority to U.S. patent application Ser. No. 15/163,969, filed May 25, 2016, and entitled "WIRELESSLY CONDUCTED ELECTRONIC WEAPON, which claims priority to U.S. Provisional Patent Application No. 62/166,495, filed on May 26, 2015, and entitled "WIRELESSLY CONDUCTED ELECTRONIC WEAPON" (the '495 application) and U.S. Provisional Patent Application No. 62/255,602, filed on Nov. 11, 2015, and entitled "WIRELESSLY CONDUCTED ELECTRONIC WEAPON" (the '602 application). The disclosures of which are hereby incorporated by reference in its entirety into the present application.

BACKGROUND

1. Field

Embodiments of the invention are broadly directed to less-lethal weaponry. More specifically, embodiments of the invention are directed to wireless electroshock weaponry.

2. Related Art

Electroshock weaponry is used as a less lethal means of subduing a person or animal. Electroshock weaponry administers an electrical shock to cause pain and disrupt the muscle function of a subject. Electroshock weapons administer the shock in three broad categories. First, stun guns, cattle prods, and the like administer the shock via direct contact. Direct contact electroshock weapons have a disadvantage of requiring the user to be within arm's reach of the potentially dangerous subject. Also, the electroshock weapon can only administer the shock so long as the weapon is in contact with the subject. Second, conducted electrical weapons ("CEWs") fire projectiles that administer the shock via thin wires. CEWs also have disadvantages such as limited range (limited to the length of the wires), limited usage (only one charge may be fired), danger to others (due to the electrically charged wires), etc. Third, long-range electroshock projectiles are fired from a standard shotgun. These electroshock weapons are essentially a small direct contact electroshock weapon that is fired at the subject. Disadvantages of this type of electronic weapon include increased risk of death of the subject (due to the extreme velocity and momentum of the projectile, especially at close range), inability to control the electrical shock after firing (which is also possible with CEWs), large form factor (shotgun is too large for carrying in many situations), and high expense. What is therefore lacking in the prior art is an electroshock weapon that incorporates the advantages of the CEW and the long range electroshock weapon without the drawbacks of each.

SUMMARY

Embodiments of the invention solve these problems by providing a wireless electroshock weapon. The wireless electroshock weapon broadly comprises a wirelessly conducted electronic weapon and at least one wireless projectile. Thus, the wireless electroshock weapon includes no wires for administration of the electrical shock. The electrical shock is administered via far field radio frequency ("RF") power extraction, as discussed below. The wireless electroshock weapon provides advantages of a conventional CEW without the wires that limit range and pose a safety hazard.

A first embodiment of the invention is broadly directed to an electroshock system comprising a launcher, a wireless projectile, a power source, and a wireless power transmitter. The launcher is configured to be grasped by a user. The wireless projectile is configured to detach from the launcher and adhere to a subject. The power source contributes power for the administration of a shock to the subject. The wireless power transmitter delivers said contributed power to the wireless projectile while the wireless projectile is detached from the launcher.

A second embodiment of the invention is broadly directed to a wireless electroshock weapon comprising a body, a chamber, a propulsion mechanism, a trigger, a transmitting antenna, and an amplifier. The body is configured to be held by a user for use. The chamber secures a projectile, and the propulsion mechanism fires the projectile. The transmitting antenna sends RF energy to the projectile while the projectile is separated from the chamber. The amplifier increases the RF energy sent to the projectile.

A third embodiment of the invention is broadly directed to a projectile configured to be fired from a launcher, the projectile comprising an adhering segment, a receiving antenna, a power extraction circuit, and a shock administration segment. The adhering segment secures the projectile to a subject. The receiving antenna is configured for wirelessly receiving shock energy. The power extraction circuit generates power from the shock energy for the administration of the shock. The shock administration segment for delivers the shock energy from the power extraction circuit to the subject.

Additional embodiments of the invention may be directed to a method of administering a shock to a subject, the method comprising the following steps: detaching and securing a projectile to the subject; sending RF energy to the projectile while the projectile is secured to the subject; receiving, by the projectile, the RF energy and converting the RF energy into shock energy to be delivered to the subject; administering the shock to the subject.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
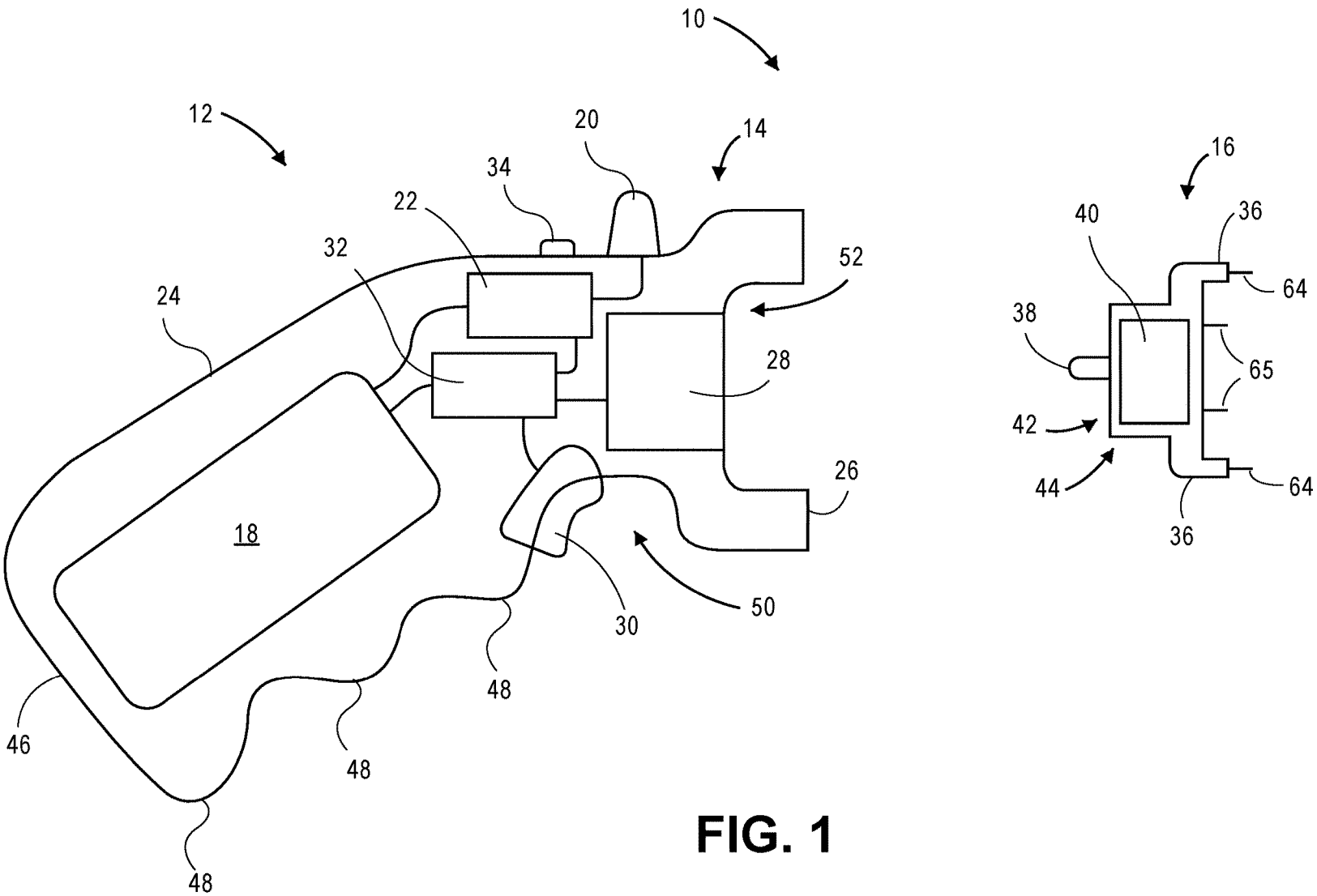
FIG. 1 is a schematic diagram illustrating a first embodiment of a wirelessly conducted electronic weapon with an internal power source and transmitting antenna as well as a projectile.

The drawing figures do not limit the invention to the specific embodiments disclosed and described herein. The drawings are not necessarily to scale, emphasis instead being placed upon clearly illustrating the principles of the invention.

DETAILED DESCRIPTION

The following description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense.

In this description, references to "one embodiment", "an embodiment", "embodiments", "various embodiments", "certain embodiments", "some embodiments", or "other embodiments" mean that the feature or features being referred to are included in at least one embodiment of the technology. Separate references to "one embodiment", "an embodiment", "embodiments", "various embodiments", "certain embodiments", "some embodiments", or "other embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to FIG. 1, an electroshock system 10 is illustrated schematically. The electroshock system 10 delivers a shock to a subject. The electroshock system 10 utilizes a wirelessly conducted electronic weapon 12 which may comprise a launcher 14, a wireless projectile 16, a power source 18, and a wireless power transmitting antenna 20. The launcher 14 is configured to be grasped by a user 22. The wireless projectile 16 is configured to detach from the launcher 14 and adhere to the subject. The power source 18 contributes power for the administration of a shock to the subject. The wireless power transmitting antenna 20 delivers said contributed power to the wireless projectile 16 while the wireless projectile 16 is detached from the launcher 14.

Typically, a user 22 (such as a law enforcement officer) utilizes the wirelessly conducted electronic weapon 12 to administer a shock to the subject. The administered shock is configured to have a less-than-lethal, disabling impact on the subject. The user 22 can therefore prevent or reduce threats to the user 22 posed by the subject. Unlike traditional CEWs, in which the wires provide a potential safety hazard and a point of failure, the wireless transmission of energy to the projectile 16 is safe, predictable, repeatable, and controllable.

Broadly, the wirelessly conducted electronic weapon 12 comprises a housing 24 for holding by the user 22, a chamber 26 for containing the projectiles 16, a propulsion mechanism 28 for firing the projectiles 16, a trigger 30 for initiating the firing, the transmitting antenna 20 for transmitting RF energy to the projectile 16, the RF amplifier 22 for increasing the amount of energy sent to the projectile 16, a control unit 32 for instructing and monitoring the administration of the shock, and at least one input 34 for directing the administration of the shock to the subject.

The projectile 16 broadly comprises an adhering segment 36 for adhering to the subject, a receiving antenna 38 for receiving RF energy, and a power extraction circuit 40 for extracting power from the received RF energy and administering this energy to the subject as an electrical shock. Some embodiments of the projectile 16 further comprise a processing element 42 and a communications element 44. The RF energy travels between the transmitting antenna 20 on the wirelessly conducted electronic weapon 12 and the receiving antenna 38 via far-field RF power extraction, as discussed below.

The housing 24 of the wirelessly conducted electronic weapon 12 is the general form factor that is gripped by the operator. In embodiments of the invention, the housing 24 is adapted to the size and shape of a hand of the operator. In some embodiments, the housing 24 includes a pommel segment 46, finger protrusions 48, and a trigger well 50. The finger protrusions 48 are configured to fit between the fingers of the user 22 while the user 22 is gripping the housing 24. The pommel segment 46 may also be gripped by at least one finger of the user 22. The pommel segment 46 may also include access to the power source 18, such as a charging port or an access port (not illustrated). In some embodiments, the housing 24 presents a general shape comparable to that of a pistol firearm. In other embodiments, the general shape of the housing 24 is distinct from that of a pistol firearm so as to decrease the likelihood that the user 22 mistakes a pistol firearm for the wirelessly conducted electronic weapon 12. Some embodiments of the housing 24 present a transmitting antenna 20, as discussed below. The housing 24 may be configured to fit within or be secured to a holster.

The chamber 26 for projectiles 16 is disposed at least in part within the housing 24. In some embodiments, such as illustrated in FIG. 1, the chamber 26 is disposed toward a firing end of the wirelessly conducted electronic weapon 12. In other embodiments, the chamber 26 is disposed within the center of the wirelessly conducted electronic weapon 12. The chamber 26 secures the projectile 16 prior to firing. The chamber 26 presents a void 52 into which the projectile 16 is placed or loaded. In some embodiments, the operator places the projectile 16 into the chamber 26 manually (i.e., with their hand). In other embodiments, the operator places the projectile 16 into the chamber 26 via a manual action, such as a pump action, slide action, or lever action. In other embodiments, the projectile 16 is loaded into the chamber 26 from a magazine via a semi-automatic loading mechanism. The wirelessly conducted electronic weapon 12 may include a magazine (not illustrated) for storing additional projectiles 16.

The propulsion mechanism 28 discharges the projectile 16 from the housing 24 and toward the subject. The propulsion mechanism 28 may operate via gunpowder, a mechanical launcher 14, or the like. The operator manipulates the launching trigger 30 to induce the propulsion mechanism 28 into operation. In some embodiments of the invention, the propulsion mechanism 28 induces the propulsion by releasing a compressed gas, by a mechanical spring, by striking an explosive charge, or the like.

Upon the action of the propulsion mechanism 28, the transmitting antenna 20 sends electrical energy to the projectile 16 for delivery to the subject. The receiving antenna 38 on the projectile 16 receives at least a portion of the transmitted electrical energy. In embodiments of the invention, the transmitting antenna 20 automatically begins transmitting electrical energy upon the firing of the projectile 16. The operator may then selectively cease the flow of electrical energy to the subject by operating the power transmission switch. In some embodiments, the operator may also reinitiate the transmission of electrical energy. In some embodiments, the transmission of electrical energy may initially cease after a certain time period, subject to re-initiation by the operator.

In some embodiments of the invention, the launcher 14 comprises an RF amplifier. The RF amplifier increases the flow of electricity to the transmitting antenna 20. This allows for a greater amount of energy to be transmitted, and thereby picked up by the receiving antenna 38. In some embodiments, the RF amplifier is associated with the power source 18 and/or the control unit 32 so as to determine an amount of amplification that is necessary or desirable for the operation of the transmitting antenna 20.

The mechanism through which the electrical energy is transmitted wirelessly from the launcher 14 to the projectile 16 will now be discussed in more detail. Embodiments of the invention utilize far-field RF power extraction to deliver electrical energy to the projectile 16. Far-field RF power extraction has been utilized for RFID tags and the like to provide electrical power to certain electrical circuits that have no associated batteries or other power sources. The circuits extract electrical power from RF energy to power whatever function the circuit is designed to perform. In embodiments of the invention, this power extraction circuit 40 is located on the projectile 16. Far-field RF power extraction has been discussed in a scholarly article by Soumyajit Mandal, entitled "Far Field RF Power Extraction Circuits and Systems," published by the Massachusetts Institute of Technology in June 2004. Far-field RF power extraction has also been discussed in U.S. Pat. No. 7,167,090 to Mandal. Both the above-mentioned article and the above-mentioned patent are hereby incorporated by reference in their entirety.

Figure 2:
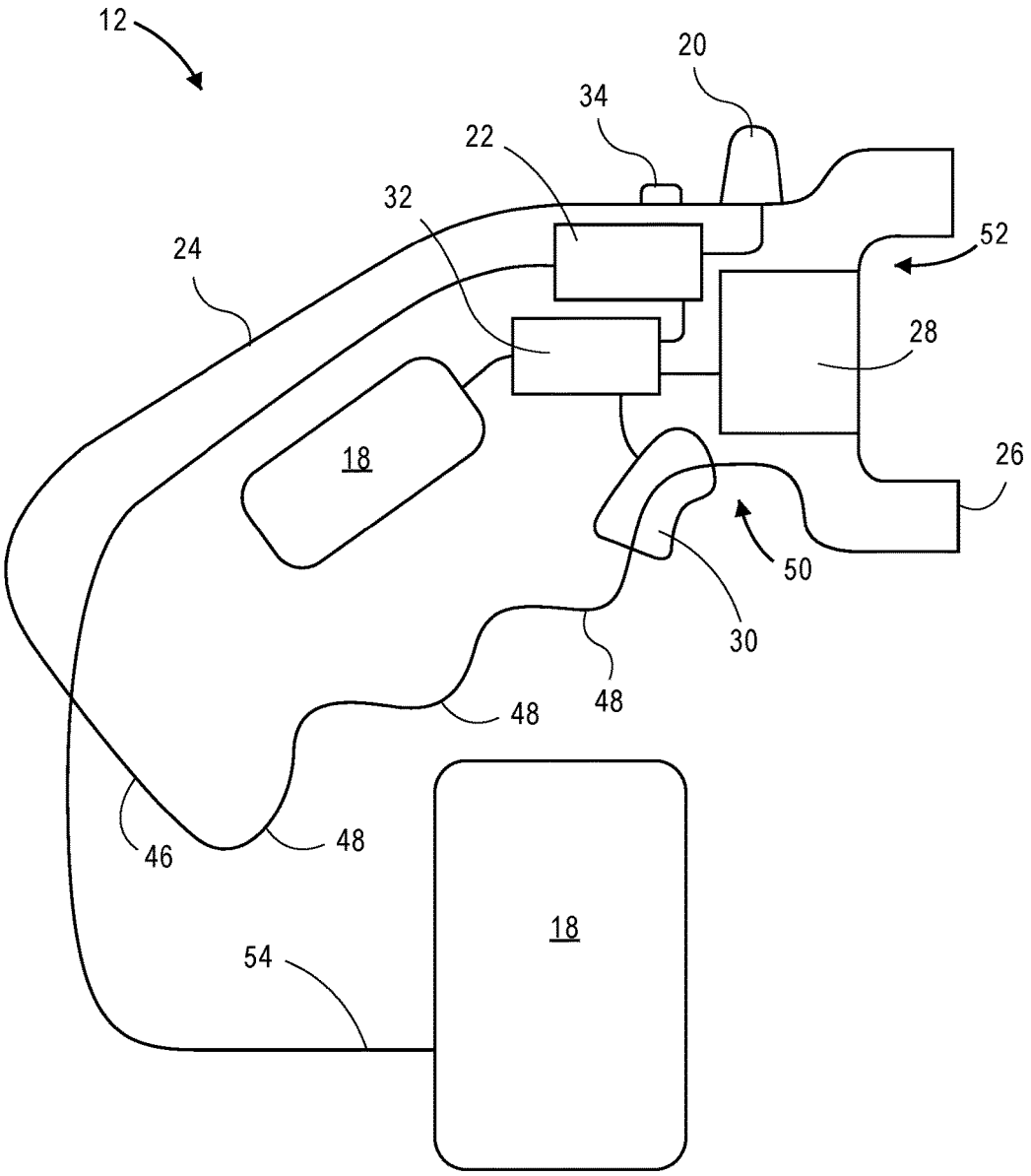
FIG. 2 is a schematic diagram illustrating a second embodiment of the wirelessly conducted electronic weapon with an external power source.
Figure 3:
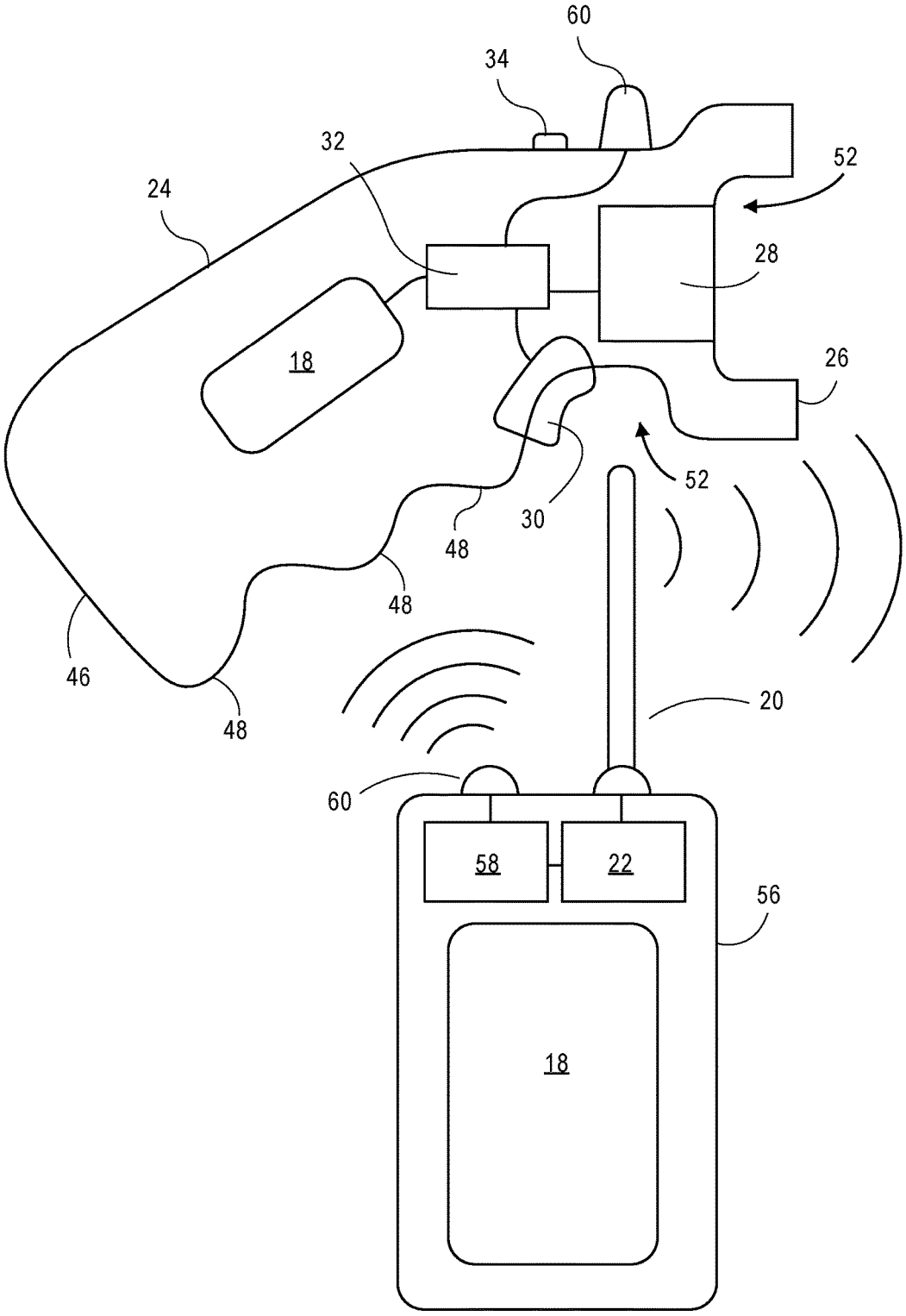
FIG. 3 is a schematic diagram illustrating a third embodiment of the wirelessly conducted electronic weapon with an external power source and transmitting antenna.

While each of the components of the wirelessly conducted electronic weapon 12 have been discussed individually, a few exemplary embodiments of how these components are arranged, housed, and interconnected will now be discussed. FIGS. 1, 2, and 3 illustrated various embodiments of the invention schematically such that the reader can get an idea of where the components are disposed within the wirelessly conducted electronic weapon 12.

In the embodiment illustrated in FIG. 1, the transmitting antenna 20 and power source 18 are disposed on the launcher 14. The launcher 14 may include at least one battery as the power source 18. The launcher 14 may also have a limited effective range, such as 20 feet. The transmitting antenna 20*s* of this embodiment may be directional. As such, the transmitting antenna 20 only transmits electrical energy in a beam range, not in all directions. The directional antenna therefore solves several of the above-discussed problems.

In the embodiment illustrated in FIG. 2, the transmitting antenna 20 is disposed on the launcher 14 and the power source 18 is disposed on the law enforcement officer but separate from the launcher 14. In this embodiment, the launcher 14 is connected to the power source 18 via a wire 54. The launcher 14 therefore draws power from the power source 18 via the wire. This embodiment therefore solves the problem of having a heavy battery in the launcher 14.

In other embodiments, the transmitting antenna 20 may also be disposed on the law enforcement officer along with the power source 18. For example, the transmitting antenna 20 and power source 18 may be located on a utility belt worn by the law enforcement officer. This reduces the issue of having a large transmitting antenna 20 on the launcher 14. It also allows the user 22 to drop or holster the launcher 14 to perform other functions while still having the option to administer an additional shock, such as via the input 34 being disposed with the transmitting antenna 20 and the power source 18.

In the embodiment illustrated in FIG. 3, the transmitting antenna 20 and power source 18 are associated with a second housing 56. The use of a second housing 56 allows the transmitting antenna 20 and power source 18 to be significantly larger and more powerful than those carried on the user 22. As illustrated in FIG. 3, the second housing 56 may include the RF amplifier, a second control unit 58, and a communication antenna 60. In this embodiment, the first housing (i.e., the launcher 14) may include a communication antenna 60 in lieu of a transmitting antenna 20. It should also be appreciated that in some embodiments the transmitting antenna 20 may also send status messages and other information to external locations, such as a recording device manage 62 (discussed below).

One example of an external location in which the second housing 56 may be located could include a law enforcement vehicle 63. Accordingly, the transmitting antenna 20 can be relatively large and located at least in part externally on the vehicle 63 and the power source 18 can pull from the vehicle's electrical system. Another example of external location could be a fixed entry point or defensive position. For example, a soldier guarding a gate to a military installation could utilize a transmitting antenna 20 and power source 18 associated with their assigned entry point. The transmitting antenna 20 could be a separately assembled antenna that draws on alternating current power from the entry point. The transmitting antenna 20 therefore can provide sufficient power to all areas in the vicinity of the entry point.

The projectile 16 will now be discussed in more detail. The projectile 16 comprises the adhering segment 36, the receiving antenna 38, and the power extraction circuit 40. Some embodiments of the projectile 16 further comprise a processing element 42 and a communications element 44. The adhering segment 36 secures the projectile 16 to the skin, clothing, or other part of the subject. The adhering segment 36, in embodiments of the invention, also delivers the electrical energy to the subject. The adhering segment 36 includes at least two probes 64 that are separated by a distance from each other. When the adhering segment 36 is attached to the subject, current passes between the two probes 64 (and through the skin of the subject) so as to administer the shock.

The receiving antenna 38 of the projectile 16 picks up RF energy transmitted by the launcher 14 or other source, as discussed below. The power extraction circuit 40 then utilizes the energy received by the receiving antenna 38 to administer the shock to the subject. The power extraction circuit 40 may also include a rectifier for rectifying the received energy, a charge pump for amplifying the rectified voltage, etc. The processing element 42 and the communications element 44 are utilized by 'smart' projectile 16*s* 16 that communicate with the launcher 14 or other device (such as the recording device manage 62) for the administration of shocks.

The electrical energy necessary to provide an adequate shock to the subject so as to disable the subject is substantial. Unlike traditional wired CEWs of the prior art, in which substantially all of the wire transmitted electrical energy is utilized in providing the shock to the subject, only a portion of the wirelessly transmitted RF energy is utilized by the power extraction circuit 40 to provide the shock. This is because the wireless transmission must provide sufficient energy in any of the directions in which the receiving antenna 38 might be located relative to the transmitting antenna 20. Similarly, the amount of energy dissipates with the distance from the transmitting antenna 20, unlike the wires of the traditional CEW that loose very little energy over their distance. In order to provide sufficient RF energy to provide an adequate shock to the subject, embodiments of the invention utilize various antennas and power source 18*s*, as discussed above.

The projectile 16, as illustrated in FIG. 1, will now be discussed. While the projectile 16 is only illustrated in FIG. 1 it should be appreciated that embodiments of the invention as illustrated in FIGS. 2 and 3 may utilize a similar projectile 16. In embodiments of the invention, the projectile 16 is communicatively linked to the launcher 14 and/or a controller for the transmitting antenna 20 and power source 18. The projectile 16 of these embodiments utilizes a processing element 42 and communications element 44. The projectile 16 may have an associated identifier. This allows the launcher 14, and/or other launchers 14 in the vicinity, to communicate with the projectile 16. The projectile 16 may send statuses to the launcher 14, and as such have a transmitting antenna 20 (that may or may not be the same as the receiving antenna 38). The statuses could include whether it is secured to the subject, whether it detects sufficient power to administer the shock (and the amount of power detected), how many shocks and at what intensity they have been administered, an estimation of the incapacitation level of the subject, and a GPS location of the projectile 16 (to aid in the location of a fleeing subject). The launcher 14 may also send information to the projectile 16, such as when and for how long to administer a shock, what intensity of shock to administer, requests for statuses or identification, the amount of power remaining in the power source 18, the approximate number of shocks remaining for the power source 18, and a command for the projectile 16 to power a light or make a noise (such that a fleeing subject can be located by law enforcement).

The projectile 16 and/or the launcher 14 may also be communicatively coupled to the recording device manage 62. The recording device manage 62 associates information related to the administration of the shock with various recording devices 66. For example, the recording device manage 62 may instruct a recording device to associate metadata from the administered shock with a video being recorded. The metadata could include information such as the time, duration, and intensity of the shock delivered. The recording device manage 62 may also instruct the recording devices 66 to begin recording upon the firing of the projectile 16 such that video data is captured of the shock administration. An exemplary recording device manage 62 is described in U.S. Pat. No. 8,781,292, which is incorporated by reference in its entirety. The recording device manage 62 is also discussed in more detail below.

In some embodiments of the invention, the projectile 16 includes a charge storage component. The charge storage component may be a capacitor and/or battery. In some embodiments, the charge storage component is charged before launch of the projectile 16. For example, the charge storage component may be a charged battery that is charged directly from the launcher 14 or other charger. The charge storage component reduces the amount of electrical energy that must be transmitted through the air to the projectile 16. The transmitted RF energy may thereafter re-charge the charge storage component. For example, in some embodiments of the invention, the RF energy transmitted wirelessly may be insufficient to be directly applied as a shock to the subject. However, a sustained transmission of RF energy charges the charge storage component over a period of time. For example, the projectile 16 may launch with the charge storage component having sufficient power for a single shock. The projectile 16 may then continue to charge after the initial shock is delivered, such that subsequent shocks may be delivered periodically as required. In still other embodiments, the control signal is used to instruct the projectile 16 to shock the subject and then no subsequent charging is performed.

In some embodiments of the invention, the launcher 14 is capable of operating as either or both traditional wired and wirelessly conducted electronic weapon 12. For example, the launcher 14 may be aware of its location relative to the transmitting antenna 20 or the available power. Based upon this information, the launcher 14 may decide (or the operator may select) whether to fire a wired or wireless projectile 16. In some embodiments, the projectile 16 is adapted to be fired in either wired or wireless configuration. In other embodiments, the launcher 14 is 'double barreled' such that there are two separate projectiles 16, one wired and one wireless, that can either be fired.

In some embodiments of the invention, the launcher 14 is adapted to operate as a direct contact electroshock weapon if desired by the operator. The projectile 16 may have a direct, wired connection to the power source 18 while the projectile 16 is disposed in the launcher 14. Upon direct contact with the subject and the operation of the power transmission switch by the user 22, the projectile 16 delivers the electrical shock to the subject. In other embodiments, the transmitting antenna 20 may wirelessly send RF energy to the projectile 16 even while the projectile 16 is in the chamber 26 for the administration of the shock.

In some embodiments of the invention, the launcher 14 releases the projectile 16 upon contact with and adherence to the subject. The launcher 14 may comprise a direct contact separation mechanism for releasing the projectile 16 upon contact. Launchers 14 of these embodiments adhere the projectile 16 to the subject without immediately administering the shock. For example, a law enforcement officer arresting a potentially dangerous subject can 'tag' (i.e. apply the projectile 16 to the subject) by applying the launcher 14 to the subject and activating the direct contact separation mechanism. This reduces the risk of death or serious injury due to the firing of the projectile 16. The law enforcement officer can then move away to a safe distance, continue the arrest, or the like. The law enforcement officer can then administer the shock by manipulating the input 34 that corresponds to the projectile 16. The threat of imminent shock may deter the subject from resisting. It will also be faster for the officer to administer the shock by manipulating the power button on the launcher 14 that is still attached to his or her belt, rather than having to draw, aim, and fire the weapon.

In some embodiments, the projectile 16 comprises a contact/removal detection mechanism 65 for determining if the subject is attempting an unauthorized removal of the projectile 16. The contact/removal detection mechanism 65 may include the test electrodes, as illustrated in FIG. 1. The test electrodes send a small electrical current therebetween to detect the electrical resistance present. The detected electrical resistance is indicative of whether the projectile 16 is fully or partially in contact with the subject. In some embodiments, the contact/removal detection mechanism 65 may additionally or alternatively include a mechanical switch, a pressure switch, a capacitive switch, or other mechanism for the detection of manipulation, touching, or interference with the projectile 16 by the subject or others.

The contact/removal detection mechanism 65 may detect the subject touching the projectile 16, the projectile 16 becoming less embedded in the subject's skin, etc. If the projectile 16 detects an unauthorized removal attempt it will request from the launcher 14 to administer a shock. The projectile 16 will then shock the subject to prevent the removal of the projectile 16. If the projectile 16 is successfully removed by the subject (or falls off inadvertently, misses the subject upon initial firing, etc.), the projectile 16 may send a message to the launcher 14 that it has been incapacitated, so that the launcher 14 may warn the operator to fire another projectile 16 or escalate the response.

In some embodiments of the invention, the launcher 14 is adapted to fire multiple projectiles 16 and oversee the administration of shocks to each. In these embodiments, there may be a transmitting input 34 for each projectile 16. For example, a launcher 14 may include three projectiles 16, each capable of being fired at a different subject, and three transmitting input 34*s*, such that the operator can selectively provide shocks to any or all of the subjects via manipulation of the three transmitting input 34*s*. In some embodiments, the successive electrical shocks are delivered automatically based upon the communicated statuses of the projectile 16, as discussed above.

In some embodiments, the recording device manage 62 or other controller may track all fired projectiles 16 and control and track the administration of shocks. For example, a controller in the law enforcement vehicle 63 may track the number and intensity of administered shocks to prevent the administration of a life-threatening shock to the subject. This will assist in preventing an unintentionally dangerous situation for the subject. In some embodiments, the user 22 may be able to override the safety limitation in an emergency (i.e., the subject is still posing a threat to the user 22).

In some embodiments of the invention, the launcher 14 and/or the recording device manage 62 is configured to administer the shock automatically. The launcher 14 and the projectile 16 may include a range detector. The range detector estimates a range that exists between the fired projectile 16 and the launcher 14. The range detector provides information related to the range and may also include location information for either or both of the launcher 14 and the projectile 16. Based upon the range information, the launcher 14 and/or recording device manage 62 may initiate shocks automatically. For example, if the range is rapidly decreasing, the shock may be administered so as to prevent the subject from overpowering or harming the user 22. As another example, if the range is reaching a maximum effective range, the shock may be administered so as to prevent the subject from moving beyond the maximum range (and thereby preventing further shocks). The shock may also continue once the subject has moved beyond the maximum range so as to encourage the subject to return within the acceptable range (until the available power to the projectile 16 is depleted or the amount of shock approaches an unsafe level, for example).

While it has been discussed throughout, a method of administering a shock to a subject will now be discussed. In one embodiment, the method comprises the following steps: detaching and securing a projectile 16 to the subject; sending RF energy to the projectile 16 while the projectile 16 is secured to the subject; receiving, by the projectile 16, the RF energy and converting the RF energy into shock energy to be delivered to the subject; and administering the shock to the subject.

Figure 4:
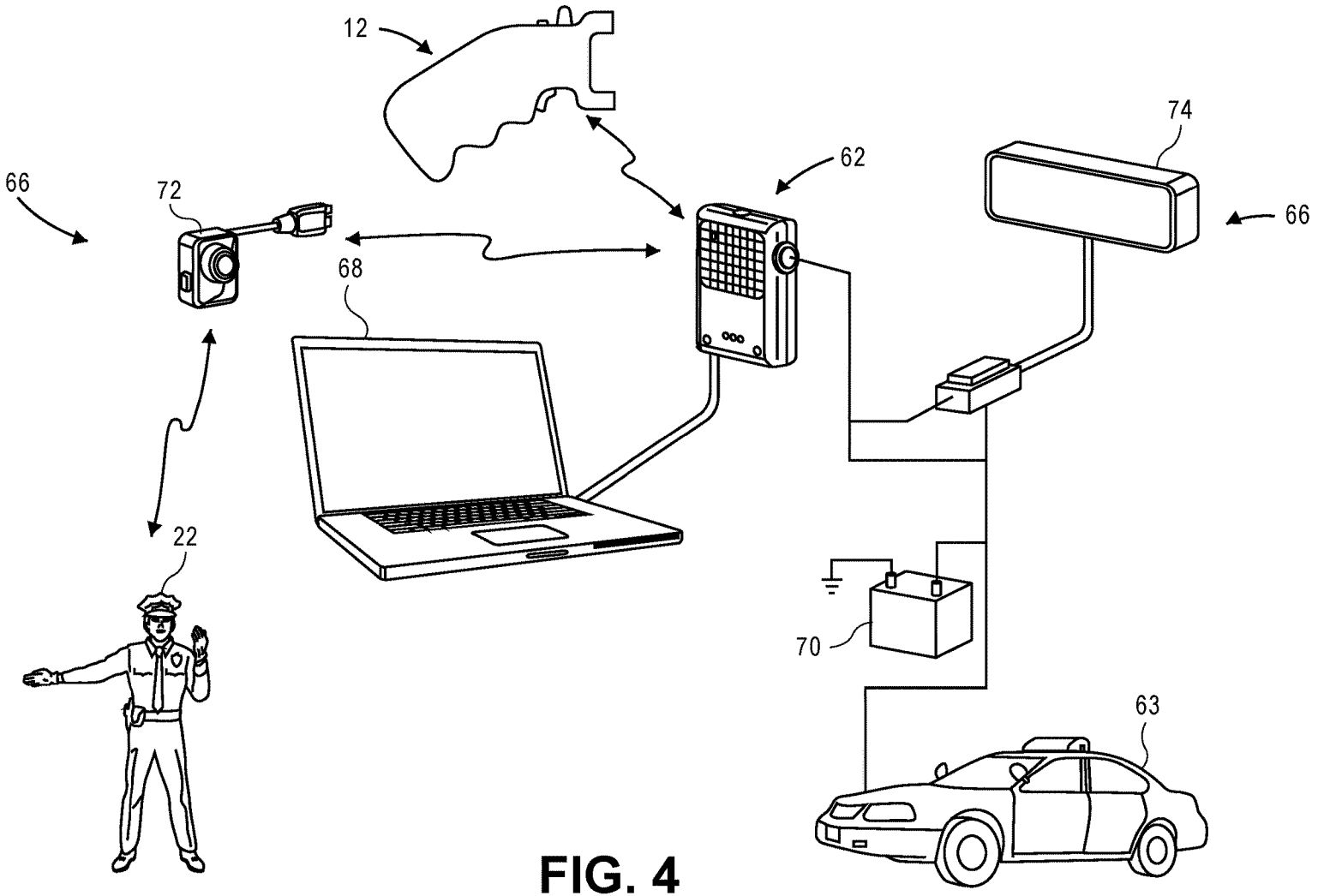
FIG. 4 is a schematic diagram illustrating a system in which the wirelessly conducted electronic weapon is utilized in conjunction with a recording device manager.

FIG. 4 illustrates a system of the embodiment in which the wirelessly conducted electronic weapon 12 is integrated into a law enforcement management system. In this embodiment, the wirelessly conducted electronic weapon 12 communicates with the recording device manage 62. The recording device manage 62 controls the operation of various recording devices 66 and other law enforcement equipment. The recording device manage 62 communicates with at least one video camera and an auxiliary computing device 68 (which may include display, processing, and storage capabilities). The recording device manage 62 may also be associated with a battery 70 or other power source 18 for powering its operations (which may be associated with the law enforcement vehicle 63).

The recording device manage 62 will now be discussed, as illustrated in FIG. 4. The recording device manage 62, such as a Digital Ally® VuLink®, controls and synchronizes various recording devices 66. For example, the recording device manage 62 links (via wireless communication, wired communication, or both) to the wirelessly conducted electronic weapon 12, a person-mounted video camera 72 on the law enforcement officer, another person-mounted video camera 72 on a second law enforcement officer, a vehicle-mounted video camera 74 in the law enforcement vehicle 63 oriented to observe events external to the law enforcement vehicle 63, a vehicle-mounted video camera 74 in the law enforcement vehicle 63 oriented to observe events internal to the law enforcement vehicle 63, and/or the auxiliary computing device 68 (referred to generically or individually as "the various recording devices"). The recording device manage 62 detects a triggering event (such as the firing of the wirelessly conducted electronic weapon 12 or when one video camera begins recording), and then instructs all other associated devices to begin recording. The recording device manage 62 may also send information indicative of a time stamp to the various recording devices 66 for corroborating the recorded data.

For example, the recording device manage 62 may instruct all associated video cameras to begin recording upon the receipt of a signal from the wirelessly conducted electronic weapon 12 that the administration of the shock has begun. This ensures that multiple video cameras record the administration of the shock, for future authentication that the administration of the shock was performed correctly. The recording device manage 62 may also send a time stamp to all the associated video cameras to provide a corroboration of the various recorded data. Further, the recording device manage 62 may send information indicative of the administration of the shock information to each of the video cameras to associate with the recorded video in metadata, to assist in the preservation of the administration of the shock information and presentation of the administration of the shock information superimposed on the recorded video, and to one or more displays in real time as discussed above to provide quick access to the information to law enforcement personnel.

The recording device manage 62 comprises a processing element, a communications element, and a memory element (not illustrated). The processing element detects the presence of the various recording devices 66. The processing element receives signals from and generates signals to the various recording devices 66 via the communications element. The recording device manage 62 also typically includes a housing that is configured to be installed within or adjacent to the law enforcement vehicle 63.

In some embodiments of the invention, the launcher 14 includes a grip detection mechanism (not illustrated) to determine if the launcher 14 is being gripped by the user 22 and/or a de-holster detection mechanism to determine if the launcher 14 is being removed from the holster. For example, either mechanism can include a mechanical switch, a pressure switch, a capacitive switch, or the like. Upon the activation of either mechanism, the launcher 14 may send a status message to the recording device manage 62 indicative that a possible administration of the shock is incipient. Upon receiving the status message, the recording device manage may then send a message to start recording to the person-mounted video camera 72 associated with the user 22, the person-mounted video camera 72 associated with other law enforcement officers in the area, and the vehicle-mounted video camera 74 associated with the law enforcement vehicle 63. In this way, the recording device manage 62 attempts to ensure that any later administration of the shock will be covered by at least one and likely many different video cameras.

The recording of the administration of the shock from multiple angles can be important in subsequent criminal and civil cases. The multiple angles may demonstrate to a fact finder (such as a judge or jury) that the administration of the shock was performed correctly, safely, and in accordance with various rules and protocols. The video data may also be overlaid with various data from the launcher 14, such as when the projectile 16 is fired, when the shock is administered, when the shock is stopped, the name or number of the user 22 and the launcher 14, the available power, the utilized power, and other such information. This information may be actively shared with the recording device manage 62 substantially in real time such that the information may be directly imposed on the video data, associated with the metadata of the video data, or later associated with the video data. Similarly, the recording device manage 62 may send to the launcher 14 information indicative of what video cameras were or are actively recording such that the launcher 14 has a record of what video cameras can be accessed to view a video of the administration of the shock. This information may additionally or alternatively be stored in the recording device manage 62, stored in the ancillary computing device, or sent to a remote computing system.

The system of embodiments of the invention may comprise computing devices to facilitate the functions and features described herein. The computing devices may comprise any number and combination of processors, controllers, integrated circuits, programmable logic devices, or other data and signal processing devices for carrying out the functions described herein, and may additionally comprise one or more memory storage devices, transmitters, receivers, and/or communication busses for communicating with the various devices of the system.

The computer program of embodiments of the invention comprises a plurality of code segments executable by a computing device for performing the steps of various methods of the invention. The steps of the method may be performed in the order described, or they may be performed in a different order, unless otherwise expressly stated. Furthermore, some steps may be performed concurrently as opposed to sequentially. Also, some steps may be optional. The computer program may also execute additional steps not described herein. The computer program, system, and method of embodiments of the invention may be implemented in hardware, software, firmware, or combinations thereof using a shipment management system, which broadly comprises server devices, computing devices, and a communications network.

The computer program of embodiments of the invention may be responsive to user 22 input 34. As defined herein user 22 input 34 may be received from a variety of computing devices including but not limited to the following: the launcher 14, the recording device manage 62, desktops, laptops, calculators, telephones, smartphones, tablets, smart watches, or other wearable technology. The computing devices may receive user 22 input 34 from a variety of sources including but not limited to the following: keyboards, keypads, mice, trackpads, trackballs, pen-input 34 devices, printers, scanners, facsimile, touchscreens, network transmissions, verbal/vocal commands, gestures, button presses or the like.

The server devices and computing devices may include any device, component, or equipment with a processing element and associated memory elements. The processing element may implement operating systems, and may be capable of executing the computer program, which is also generally known as instructions, commands, software code, executables, applications ("apps"), and the like. The processing element may include processors, microprocessors, microcontrollers, field programmable gate arrays, and the like, or combinations thereof. The memory elements may be capable of storing or retaining the computer program and may also store data, typically binary data, including text, databases, graphics, audio, video, combinations thereof, and the like. The memory elements may also be known as a "computer-readable storage medium" and may include random access memory (RAM), read only memory (ROM), flash drive memory, floppy disks, hard disk drives, optical storage media such as compact discs (CDs or CDROMs), digital video disc (DVD), and the like, or combinations thereof. In addition to these memory elements, the server devices may further include file stores comprising a plurality of hard disk drives, network attached storage, or a separate storage network.

The computing devices may specifically include mobile communication devices (including wireless devices), work stations, desktop computers, laptop computers, palmtop computers, tablet computers, portable digital assistants (PDA), smart phones, smart watches, other smart wearables, and the like, or combinations thereof. For example, there may be a laptop computer disposed in the law enforcement vehicle 63 along with the recording device manage 62, dash camera, and the like. Various embodiments of the computing device may also include voice communication devices, such as radios, satellite phones, cell phones, smart phones. In some embodiments, the computing device will have an electronic display operable to display visual graphics, images, text, etc. In certain embodiments, the computer program facilitates interaction and communication through a graphical user 22 interface (GUI) that is displayed via the electronic display. The GUI enables the user 22 to interact with the electronic display by touching or pointing at display areas to provide information to the system.

The communications network may be wired or wireless and may include servers, routers, switches, wireless receivers and transmitters, and the like, as well as electrically conductive cables or optical cables. The communications network may also include local, metro, or wide area networks, as well as the Internet, or other cloud networks.

Furthermore, the communications network may include cellular or mobile phone networks, as well as landline phone networks, public switched telephone networks, fiber optic networks, or the like.

The computer program may run on computing devices or, alternatively, may run on one or more server devices. In certain embodiments of the invention, the computer program may be embodied in a stand-alone computer program (i.e., an "app") downloaded on a user 22's computing device or in a web-accessible program that is accessible by the user 22's computing device via the communications network. As used herein, the stand-along computer program or web-accessible program provides user 22*s* with access to an electronic resource from which the user 22*s* can interact with various embodiments of the invention.

In embodiments of the invention user 22*s* may be provided with different types of accounts. Each type of user 22 account may provide their respective user 22*s* with unique roles, capabilities, and permissions with respect to implementing embodiments of the invention. For instance, a law enforcement officer may be provided with a user 22 account for tracking the administered shocks, associating performed shocks with the officer, providing training, etc. Additionally, a dispatcher or supervisor may be provided with a supervisory account that permits the dispatcher/supervisor to access embodiments of the invention that are applicable to managing the wirelessly conducted electronic weapons 12, monitor the status, receive alerts of discharges wirelessly conducted electronic weapons 12, etc. A system administrator may be provided with an administrator account to access embodiments of the invention that are applicable to monitoring the operation of the system and solving problems. In addition, any number and/or any specific types of accounts is provided as may be necessary to carry out the functions, features, and/or implementations of the invention. Upon a law enforcement officer, a supervisor/dispatcher, or an administrator logging in to the electronic resource for a first time, that user 22 may be required to provide various items of identification information to create their respective accounts. Such identification information may include, for instance, personal name, business name, email address, phone number, or the like. Upon providing the identification information, the user 22 may be required to enter (or may be given) a user 22 name and password, which will be required to access the electronic resource.

It should be appreciated that, while the above disclosure is directed mainly to the field of law enforcement, some embodiments of the invention are associated with other fields. Some embodiments of the invention are directed to military functions, para-military functions, private security functions, private citizens, etc. For example, the user 22 may be a private citizen and the subject may be an assailant or other malfeasant. The law enforcement field discussed is merely exemplary and should not be construed as limiting.

Although the invention has been described with reference to the embodiments illustrated in the attached drawing figures, it is noted that equivalents may be employed and substitutions made herein without departing from the scope of the invention.

Having thus described various embodiments of the invention, what is claimed as new and desired to be protected by Letters Patent includes the following:

1. A wireless electroshock weapon configured to administer a shock to a subject, comprising:

a wireless projectile configured to be launched toward and adhere to the subject;

a launcher body for holding by a user;

a launcher chamber for securing the wireless projectile prior to launching; and a transmitting antenna for transmitting shock energy to the wireless projectile that has been fired, wherein the wireless projectile includes a circuit board having a power extraction circuit for generating power from the shock energy, wherein the wireless projectile is configured to administer the shock to the subject to whom the wireless projectile is adhered, wherein a majority of the shock is the shock energy from the transmitting antenna.

2. The wireless electroshock weapon of claim 1, further comprising:

an amplifier for increasing the shock energy sent to the wireless projectile.

3. The wireless electroshock weapon of claim 1, wherein the wireless projectile is launched by releasing a compressed gas, wherein the wireless projectile is configured to selectively separate from the wireless electroshock weapon upon direct contact with and adherence to the subject.

4. The wireless electroshock weapon of claim 1, wherein the transmitting antenna is a directional antenna for directing said shock energy in a general direction of the wireless projectile while the wireless projectile is adhered to the subject, wherein the shock energy is RF energy.

5. The wireless electroshock weapon of claim 1, further comprising:

a power source disposed outside said launcher body; and a wire connecting the power source to the launcher body, wherein the power source provides at least a portion of the shock energy transmitted to the wireless projectile.

6. The wireless electroshock weapon of claim 5, wherein the launcher chamber, the power source, and the transmitting antenna are disposed at least partially within the launcher body.

7. The wireless electroshock weapon of claim 5, further comprising:

a housing distinct from the launcher body, wherein the power source and the transmitting antenna are disposed at least partially within or on the housing.

8. The wireless electroshock weapon of claim 7, wherein the housing is configured to be secured to the user.

9. The wireless electroshock weapon of claim 7, wherein the housing is configured to be installed in a vehicle.

10. The wireless electroshock weapon of claim 1, further comprising:

a switch for controlling the shock to the subject, wherein, upon an activation of the switch, the wireless projectile is instructed to administer the shock to the subject, wherein, upon a deactivation of the switch, the wireless projectile is instructed to cease administration of the shock to the subject.

11. The wireless electroshock weapon of claim 10, wherein said instruction to administer the shock is distinct from the transmitted shock energy.

12. A wireless electroshock weapon configured to administer a shock to a subject, comprising:

a launcher including— a body for holding by a user;

a transmitting antenna for transmitting shock energy; and a wireless projectile configured to be launched from the launcher, including— an adhering segment having at least two probes for adhering the projectile to the subject;

a receiving antenna for wirelessly receiving shock energy;

a circuit board having a power extraction circuit for generating power from the shock energy to administer the shock, wherein said at least two probes are configured for delivering the shock energy from the power extraction circuit to the subject.

13. The wireless electroshock weapon of claim 12, wherein the at least two probes are disposed in a forward direction, wherein the receiving antenna is disposed in a rearward direction, wherein the rearward direction is generally opposite the forward direction and generally directed toward the launcher upon the projectile being fired from the launcher.

14. The wireless electroshock weapon of claim 12, wherein the projectile further includes:

a processing element for controlling the shock; and a communications element for sending a plurality of status messages to the launcher.

15. The wireless electroshock weapon of claim 14, wherein the communications element is configured to receive a message indicative that the projectile should administer the shock.

16. The wireless electroshock weapon of claim 14, wherein the plurality of status messages includes a first status message indicative that the projectile has sufficient power for the administration of the shock, wherein the plurality of status messages includes a second status message indicative that the projectile is in direct contact with and adhering to the subject.

17. A method of administering a shock to a subject, comprising:

firing a wireless projectile toward the subject;

transmitting, from a transmitting antenna, shock energy to the wireless projectile that has been fired, wherein the wireless projectile includes a circuit board having a power extraction circuit for generating power from the shock energy to administer the shock, is configured to deliver the shock to the subject to whom the wireless projectile is adhered, delivering, via the wireless projectile, the shock to the subject.

18. The method of claim 17, further comprising:

amplifying energy from a power source to create the transmitted shock energy sent to the projectile, wherein the transmitted shock energy is RF energy.

19. The method of claim 17, further comprising:

receiving, from a switch, an instruction from a user to administer the shock;

wirelessly instructing the wireless projectile that was previously fired to administer the shock, wherein said instruction to administer the shock is distinct from the shock energy.

20. The method of claim 17, further comprising:

receiving, from the wireless projectile, an indication that the wireless projectile is properly adhered to the subject; and preventing administration of the shock unless the indication is received.

* * * * *